US007544956B2

(12) United States Patent
Watson

(10) Patent No.: US 7,544,956 B2
(45) Date of Patent: Jun. 9, 2009

(54) METHOD OF FORMING A SLIP-RESISTANT PHOTO-LUMINESCENT DEVICE

(75) Inventor: Julian Mark Watson, Leeston (NZ)

(73) Assignee: Ecoglo Limited, Christchurch (NZ)

( * ) Notice: Subject to any disclaimer, the term of this patent is extended or adjusted under 35 U.S.C. 154(b) by 24 days.

(21) Appl. No.: 10/577,606

(22) PCT Filed: Oct. 28, 2004

(86) PCT No.: PCT/NZ2004/000268

§ 371 (c)(1),
(2), (4) Date: Jan. 8, 2007

(87) PCT Pub. No.: WO2005/039785

PCT Pub. Date: May 6, 2005

(65) Prior Publication Data

US 2007/0210263 A1 Sep. 13, 2007

(30) Foreign Application Priority Data

Oct. 28, 2003 (NZ) ..... 529183

(51) Int. Cl.
*F21K 2/00* (2006.01)

(52) U.S. Cl. ..... 250/462.1; 427/158; 428/147

(58) Field of Classification Search ..... 250/458.1, 250/462.1, 459.1; 118/304, 308; 427/71, 427/157, 189, 196, 158; 428/143, 144, 147
See application file for complete search history.

(56) References Cited

U.S. PATENT DOCUMENTS 3,589,087 A 6/1971 De Lazzero
4,058,942 A * 11/1977 Naka ..... 52/179
4,360,557 A * 11/1982 Miller ..... 428/142
4,998,391 A * 3/1991 Connew ..... 52/179
5,103,608 A * 4/1992 Andreo ..... 52/179
5,363,887 A * 11/1994 Haeberli ..... 141/12
5,763,070 A * 6/1998 Kerlek et al. ..... 428/329
5,904,017 A * 5/1999 Glatz et al. ..... 52/287.1
6,696,126 B1 * 2/2004 Fischer et al. ..... 428/40.2
6,726,952 B1 * 4/2004 Dimond et al. ..... 427/71
6,841,785 B2 * 1/2005 Nolt ..... 250/462.1
6,875,989 B2 * 4/2005 Nolt ..... 250/462.1
7,297,388 B2 * 11/2007 Dimond et al. ..... 428/172

FOREIGN PATENT DOCUMENTS

WO WO 01/05519 A1 * 1/2001

* cited by examiner

*Primary Examiner*—David P Porta
*Assistant Examiner*—David S Baker
(74) *Attorney, Agent, or Firm*—Knobbe Martens Olson & Bear LLP

(57) ABSTRACT

A method of manufacturing a slip-resistant photo-luminescent device includes dispensing first and second powdered components into respective recesses (8, 13) provided in a substrate (7) such as a metal strip. The first powdered component includes a resin and a friction enhancing material, the second powdered component includes a resin and a photo-luminescent pigment. The powdered components are then heated (4) to fuse the resins and bond them to surfaces of the respective recesses (8, 13). A channel (15) is formed between the first and second recesses (8, 13) for receiving traces of the first and second components that may spill from the adjacent recesses.

12 Claims, 4 Drawing Sheets

12
15
14

28
27
8
8
8
26
7

12
9
12
8
12
8
12
8
10
15
AA
14
13
7
11
14

18
7
25
13
29

22
22
22
15
23
7

METHOD OF FORMING A SLIP-RESISTANT PHOTO-LUMINESCENT DEVICE

TECHNICAL FIELD

The present invention relates to the manufacture of slip-resistant photo-luminescent devices for surfaces such as stair treads and in particular to strips made from powdered resins.

BACKGROUND ART

Many environments exist wherein safety or other considerations are improved by the availability of a surface which provides a marking visible in darkness, together with improved friction. A typical application is for markings, signage or the like for steps, floors, hand rails and ladders which combine photo-luminescent materials to help guide building occupants to safety during blackout situations, together with an anti-slip coating for safety.

U.S. Pat. No. 5,103,608 describes a stair nosing comprising an extrusion having strips of photo-luminescent paint alternating with raised strips of slip-resistant material. This device is relatively costly to manufacture, owing to the difficulties of assembling, or otherwise forming the strips of slip-resistant material into the dovetail grooves in the extrusion.

The applicant's U.S. Pat. No. 6,726,952 describes a method and apparatus for manufacturing a photo-luminescent device such as a nosing for stairs in the form of a section having channels into which a thermosetting resin and pigment are applied to form photo-luminescent strips. The photo-luminescent pigment is applied to the stair nosing by mixing powdered photo-luminescent pigment with a carrier also in powdered form, dispensing the powdered mixture into a recess in the stair nosing, then heating the powdered mixture to fuse the resins and bond them to surfaces of the recess. The edges of the channels protrude to contrast to the radiance of the luminescent material in the channels for enhanced visibility. Although the manufacturing method described in this patent allows photo-luminescent strip devices to be produced in a cost-effective manner, it will be appreciated that there is an ongoing need for an improved method of manufacturing these devices. While the channel edges form non-slip strips and present a foot-engaging surface which protrudes above the luminescent strips, it would be advantageous if such a method provided a device with a greater degree of slip resistance than that of the device of U.S. Pat. No. 6,726,952 without a significantly increased number of manufacturing operations.

All references, including any patents or patent applications, cited in this specification are hereby incorporated by reference. No admission is made that any reference constitutes prior art. The discussion of the reference states what their authors assert, and the applicants reserve the right to challenge the accuracy and pertinency of the cited documents. It will be clearly understood that, although a number of prior art publications are referred to herein, this reference does not constitute an admission that any of these documents forms parts of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF THE INVENTION

According to one aspect of the present invention there is provided a method of manufacturing a slip-resistant photo-luminescent device, including the steps:

a) preparing a first powdered component including at least a resin and a friction-enhancing material;
b) preparing a second powdered component including at least a resin and a photo-luminescent pigment;
c) providing a substrate having at least one first recess configured for receiving the first powdered component and at least one second recess configured for receiving the second powdered component;
d) dispensing the first and second powdered components into the first and second recesses, and
f) heating the powdered components to fuse the resins and bond them to surfaces of the respective recesses.

The same or different classes or compositions of resin may be used in each powdered component, but preferably the resins are thermosets for improved mechanical properties such as strength and wear resistance. Both resins may be a heat curable polymer, most preferably hydroxy or carboxyl polyester which crosslinks through a chemical reaction with a hardener.

The friction-enhancing material is preferably particulate material, such as silicon carbide or aluminium oxide. Alternatively the friction-enhancing material may be other grit or hard refractory piecewise material.

The substrate is preferably an elongate metal strip and the recesses are parallel and longitudinally extending though it will be appreciated alternative configurations are possible. The first and second powdered components are preferably dispensed simultaneously into the elongate substrate, thus reducing manufacturing time and costs e.g. compared to dispensing them in separate runs through one dispenser.

Preferably the first and second recesses face upwardly when dispensing the first and second powdered components and each powdered component is gravity fed from a hopper through a die into the respective recesses, the die having a face adapted for sliding engagement with the substrate. Preferably the first and second powdered components are mounded up in the first and second recesses so as to extend above an upper edge of each recess. The hoppers may be fixed and spaced apart above means for supporting the substrate upright for sliding movement between the dies. The substrate is fed past each die while maintaining sliding engagement therewith so as to dispense the powdered components into recesses.

Preferably the substrate includes a channel between the first and second recesses. This channel is a depression provided for receiving any traces of the first and second components that may spill from the adjacent recesses. The channel preferably extends between any two first and second recesses and is parallel to and coextensive with the recesses.

This slip-resistant photo-luminescent device is particularly adapted to be manufactured by the above-described method to avoid contamination of the strips which may otherwise occur should traces of the first and second components spill from the adjacent recesses. The channel may contain any trace amounts of the components that are spilled thereinto, thus improving the aesthetics of the finished device.

Thus, the channel reduces the risk of cross-contamination between the first and second components, which could cause a visual blurring of the interface between the components. The reverse also consistently creates a distinct crisp edge between the two components thus enhancing the visual impact of the device in terms of control and definition.

In another aspect the invention provides apparatus for performing the method substantially as described above, the apparatus including:

- a first hopper adapted to contain the first powdered component, the first hopper being adapted to allow continuous transfer of the powdered component from the first hopper through a first die to the first at least one recess by operation of gravity;
- a second hopper adapted to contain the second powdered component, the second hopper being adapted to allow continuous transfer of the powdered component from the second hopper through a second die to the second at least one recess by operation of gravity;
- a transport device for holding the substrate below the hopper in sliding engagement with the first and second dies to permit continuous delivery of the first and second powdered components into the recesses; and
- an oven adapted to receive at least a portion of the substrate, the oven providing sufficient heat to turn the first and second components into a molten mixture.

Preferably a trailing edge of each die governs the depth of the powdered component dispensed into the recesses and the trailing edge is shaped to provide mounds of powdered component extending above the uppermost edge of the recesses.

In still another aspect the invention provides apparatus a slip-resistant photo-luminescent device including:

- a substrate having at least one first recess and at least one second recess therein
- a strip of photo-luminescent material bonded to each first recess,
- a strip of friction-enhancing material bonded to each second recess, wherein
- both the strip of photo-luminescent material and strip of friction-enhancing material are formed from heat-curable powdered resins heated to fuse the resins and bond them to surfaces of the respective recesses.

Slip-resistant photo-luminescent devices may be economically manufactured by the method of the present invention, avoiding the costs of additional forming or assembly stages. The simplicity of the method means it can be performed using simple, low cost equipment.

BRIEF DESCRIPTION OF THE DRAWINGS

Further aspects of the present invention will become apparent from the following description which is given by way of example only and with reference to the accompanying drawings in which.

BEST MODES FOR CARRYING OUT THE INVENTION

Figure 1:
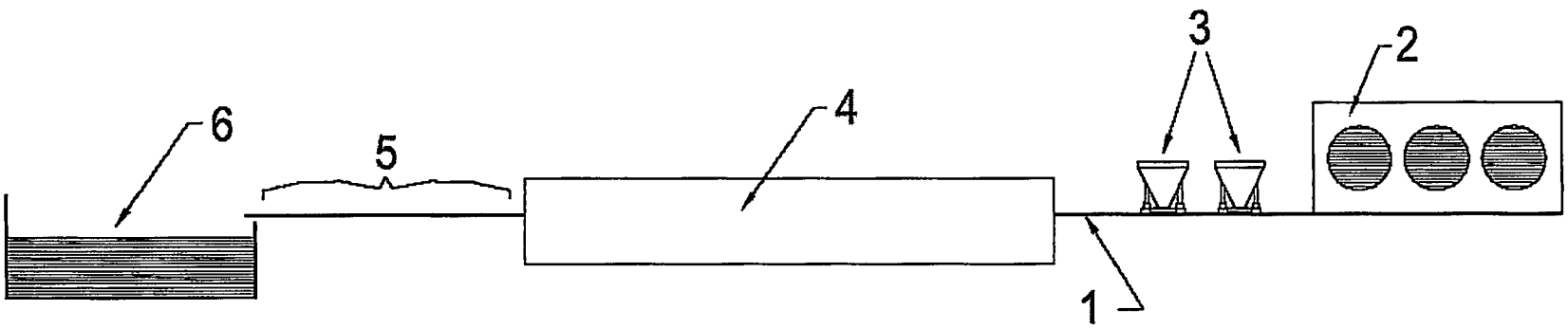
FIG. 1 is a schematic of apparatus for performing the process of the present invention.

The invention provides for a method and apparatus for manufacturing a slip-resistant photo-luminescent device, which can be used to provide floor, stair or other courtesy or emergency lighting. Apparatus for forming a slip-resistant photo-luminescent device according to the present invention is schematically illustrated in FIG. 1 and includes transport device 1 for moving an elongate substrate 7 such as metal or aluminium strips (see FIGS. 2*a*-2*d*) consecutively from a loading station 2, through a dispenser 3, an oven 4, and a cooler 5 to an unloading station 6.

The transport device 1 is preferably a conveyor (e.g. a roller conveyor) which supports the substrate 7 maintaining it substantially horizontal.

Figures 2A, 2B, 2C, 2D, 2E:
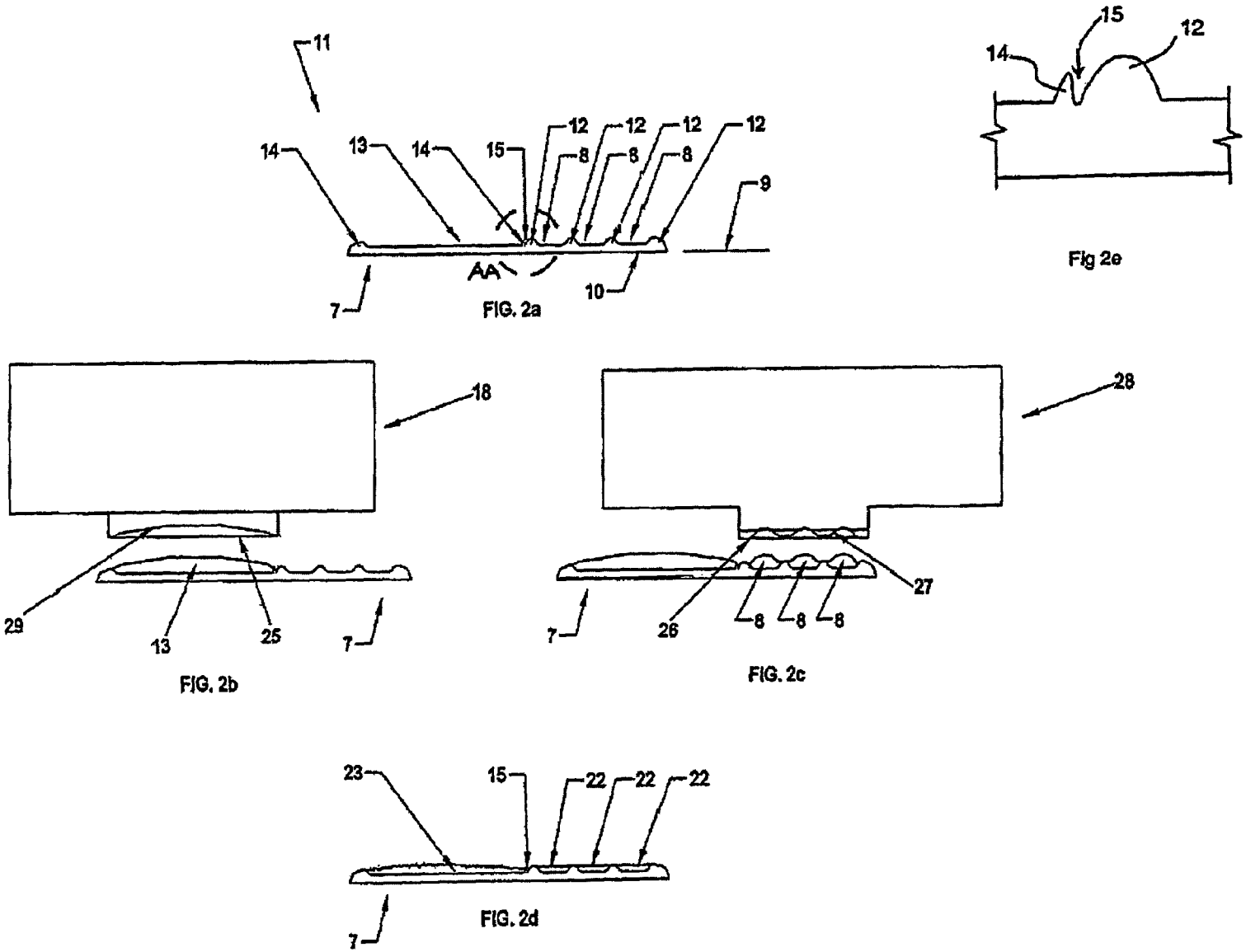
FIG. 2*a* is a transverse view of a substrate of the device prior to a first stage of the process of the present invention.
FIG. 2*b* is a transverse view of the device after a first stage of the process of the present invention.
FIG. 2*c* is a transverse view of a substrate of the device after a second stage of the process of the present invention.
FIG. 2*d* is a transverse view of a substrate of the device upon completion of the process of the present invention.
FIG. 2*e* is a scrap view of portion AA from FIG. 2*a;*
Figure 3:
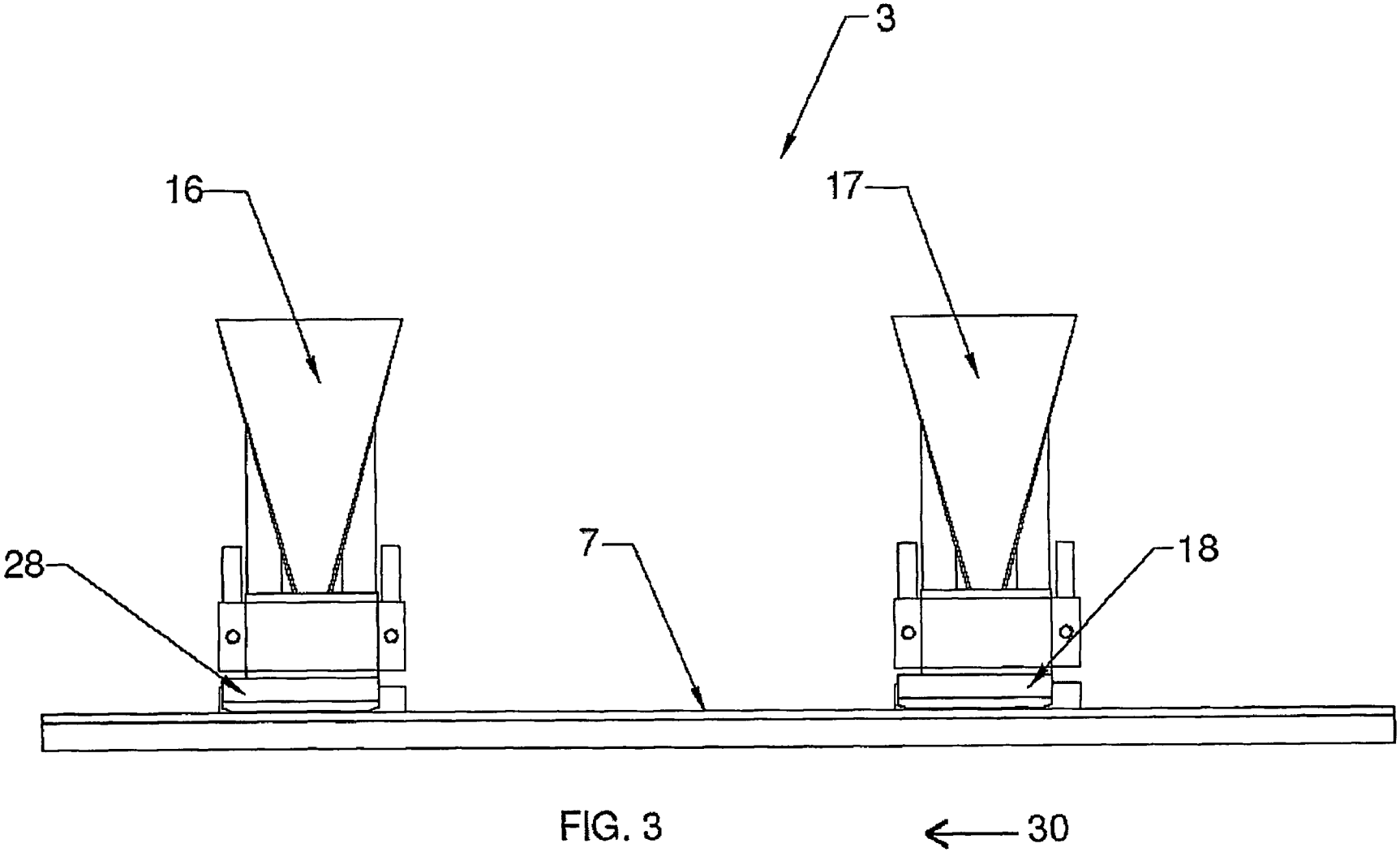
FIG. 3 is a side view of the dispenser of the apparatus of FIG. 1.
Figure 4:
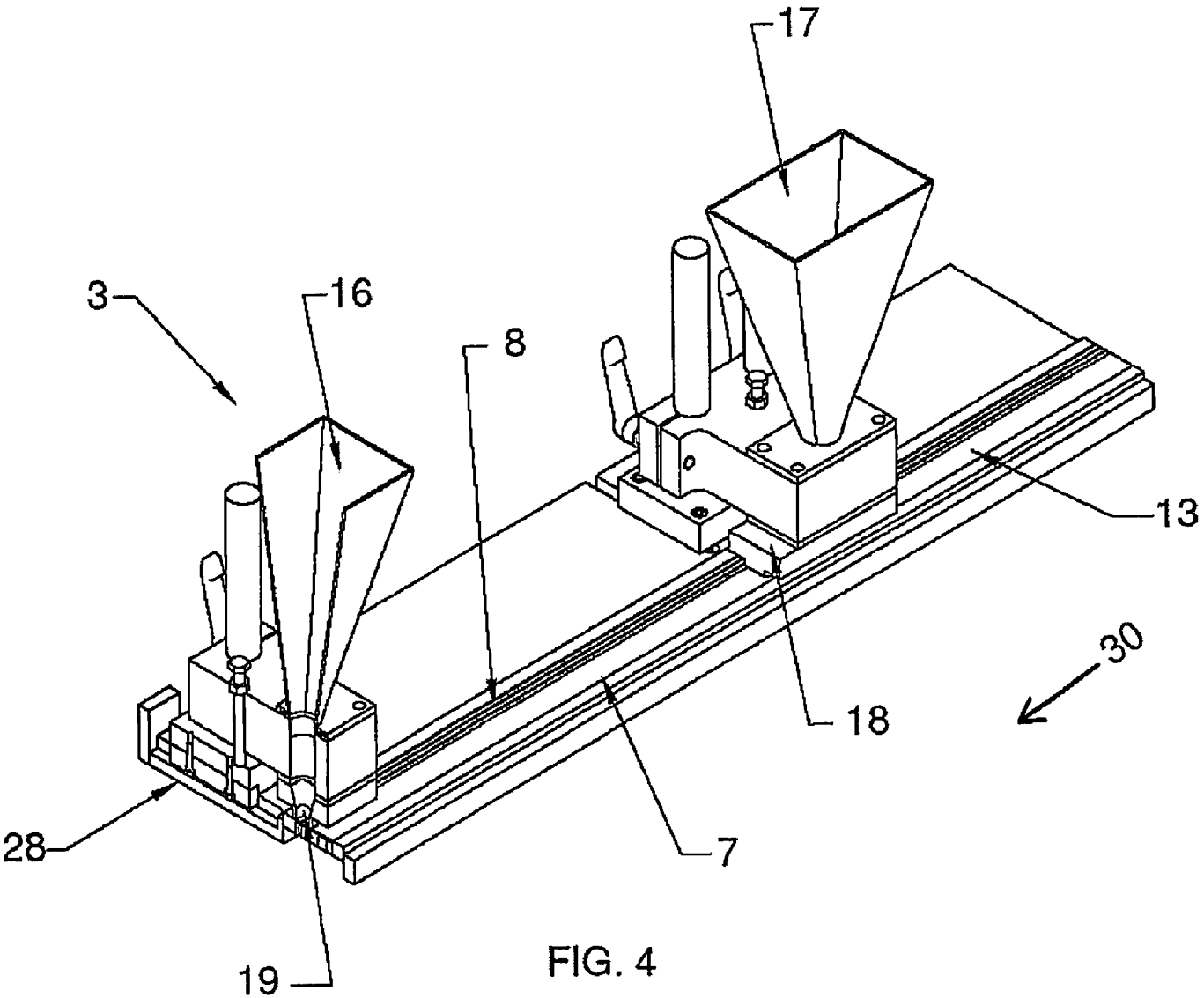
FIG. 4 is pictorial view of the dispenser of FIG. 3 showing the hopper and die partly cut away.

FIGS. 2*a*-2*d* show transverse views of the substrate 7 at successive stages in the manufacturing process. Referring to FIG. 2*a*, the substrate 7 loaded at station 2 has an upper face 11 and an opposing lower face 10 supported upon a substantially horizontal surface 9. Three parallel recesses 8 in the upper face 11 are bounded by upstanding edges 12 of substantially the same height such that their uppermost ends are generally coplanar. A recess 13 in the upper face 11 is bounded by opposing upstanding edges 14 and separated from the recesses 8 by a channel 15 formed between the adjacent edges 12 and 14. A substrate of a thickness of 1-2 mm is found to be ideally suited for the purposes of the present invention. Although thicker substrates may be used, the hazards of tripping or stumbling over the surface increase as the thickness increases. Accordingly, the thickness is preferably no more than about 2 mm. If thinner substrates are used, the likelihood of the substrate buckling during processing, handling or installation increases.

The substrate 7 is preferably an aluminium extrusion powder coated white for improved reflectivity, especially in the UV region. For compatibility with the preferred resins used in subsequent stages, a polyester powder coating resin is used, which is fully cured to provide a high gloss.

After loading the substrate 7 onto the transport device 1, the second step is passing the substrate 7 through the dispenser 3, where the recess 13 is filled with a first powdered component and the recesses 8 with a second powdered component, as shown in FIGS. 2*b* and 2*c* respectively.

The dispenser 3 includes two hoppers 16, 17 from which the first and second powdered components are delivered into the recesses 8 and 13 respectively. The components are gravity fed simultaneously while the substrate 7 is moved on the transport device 1 below the hoppers 16, 17 in direction 30.

The first powdered component includes a resin mixed with friction-enhancing material, and the second powdered component includes a resin mixed with a photo-luminescent pigment.

The preferred thermoset polymer resin of this invention is a polyester, the resins used in both components may be the same or different classes of polyester. There are many polyester resins available on the market from several different suppliers. The polyesters that are preferred for mixing with the photo-luminescent pigment are those that are transparent to a range of frequencies of radiation and feature good strength, and hardness when fully cured. The cured resin should possess these properties over a wide temperature range while at the same time providing resistance to impact, and cracking. The resin is heat curable, preferably being a hydroxy or carboxyl polyester which crosslinks through a chemical reaction with a hardener. A flow improving additive and degassing agent, preferably in the form of a silica fume, is also added to the powdered components.

The friction-enhancing material is preferably grit. Silicon carbide, aluminium oxide and silica are three types of grit that can be used although in a preferred embodiment, aluminium oxide is the grit of choice. A mixture of two or more of these compounds may also be used. In an embodiment of the invention intended for heavy commercial use, the aluminium oxide grit has a particle size distribution from 30 to 800 micron, but biased toward the 600-800 micron range. If the product of this invention is to be sold for uses that are less demanding than the commercial market, particles having a smaller grit size may be used, thus producing a less abrasive surface. Like the photo-luminescent pigment, the grit is mixed with the powdered resin and additives, so as to be evenly distributed throughout the resulting powdered component.

Referring to FIGS. 2*b*, 2*c*, 3 and 4, the hoppers 16, 17 empty into dies 18 and 28 having openings 19 above the recesses 13 and 8. The substrate 7 is laterally restrained between guides (not shown) and supported upon rollers (not shown) of the transport device 1 which may be driven. The two dies 18, 28 have respective lower faces 25 and 26 in sliding engagement with part of the upper face 11 of the substrate 7.

The two dies 18, 28 are adapted to suit the substrate 7 being used and, except for a trailing edge 27 and 29 abut neatly over substrate 7 on the leading edge and opposing sides so that none of the powdered component is spilled. The trailing edge 27 and 29 of each die 18, 28 wipes the edges 11 and governs the depth of the powdered component in the recesses 8, 13. As shown, the trailing edges 27, 29 are shaped to provide smoothly rounded mounds of powdered component in each of the recesses 8 and recess 13, extending above the respective edges 12 and 14. The trailing edge 27 of the die 28 has three arcuate portions to mound the first powdered component in each of the three recesses 8. The thickness of the layers of powdered components are between about 0.5 and about 2 mm. Various dies may be interchangeable to provide for different substrates.

Next, the resin is cured for example by heating in the oven 4 to a temperature such as 160-200 degree C. for 10-20 minutes, during which the powdered components fuse and bond to the substrate 7. As shown in FIG. 2*d* the resulting device includes three photo-luminescent strips 22 and an anti-slip strip 23 with a channel 15 therebetween. When the components become molten the air between the particles is expelled and the subsequently fused material forms a thick layer that smoothly covers both the horizontal and vertical surfaces of the recesses 8, 13 in the substrate 7. The resulting photo-luminescent strips 22 fill the recesses 8 so that no depression is provided between adjacent strips 22 to collect dirt. The anti-slip strip 23 protrudes above the edges of the recess 13 for improved slip-resistance.

The channel 15 may contain (fused) traces of the first and second components which have spilled from the adjacent recesses 8, 13. The channel 15 may be approximately 1 mm wide and approximately 0.5 mm deep. The channel 15 thus serves to avoid cross contamination between the recesses 8, 13 (and the resulting adjacent strips 22, 23 separated by the channel 15) that may otherwise occur from such spillage. Such contamination would detract from the appearance of the device, whereas the trace amounts in the channel 15 do not detract from the aesthetics of the finished device. A visually sharply defined boundary is thereby provided between the strip 22 and channel 15. The fourth step is the cooling of the device, following which it may be removed from the transport device.

The device of the present invention is designed to improve safety by preventing slipping on landings, walkways, catwalks, work stations, platforms, ramps, etc. The device may be applied to stairs (facing upward adjacent to the edge of each step) or to floors. The substrate is held in place by bonding the lower face 10 adhesively to the floor, stair treads or the like. Such devices may be manufactured by the method of the present invention in a very cost-effective manner, avoiding the time and expense of additional forming or assembly stages and allowing simple, low cost equipment to be employed.

Aspects of the present invention have been described by way of example only and it should be appreciated that modifications and additions may be made thereto without departing from the scope thereof as defined in the appended claims.

The invention claimed is:

1. A method of manufacturing a slip-resistant photo-luminescent device, comprising the steps:

a) preparing a first powdered component comprising at least a resin and a friction-enhancing material;

b) preparing a second powdered component comprising at least a resin and a photo-luminescent pigment;

c) providing a substrate having at least one first recess configured for receiving the first powdered component and at least one second recess configured for receiving the second powdered component;

d) dispensing the first and second powdered components into the first and second recesses, and e) heating the powdered components to fuse the resins and bond them to surfaces of the respective recesses.

2. The method of claim 1 wherein both resins are a heat curable polymer.

3. The method of claim 2 wherein both resins are hydroxy or carboxyl polyester.

4. The method of claim 1 wherein the first and second recesses face upwardly when dispensing the first and second powdered components and each powdered component is gravity fed from a hopper through a die into the respective recesses.

5. The method of claim 4 wherein the substrate is fed past each die while maintaining sliding engagement therewith so as to dispense the powdered components into recesses.

6. The method of claim 1 wherein the substrate is an elongate metal strip and the recesses are parallel and longitudinally extending.

7. The method of claim 1 wherein the first and second powdered components are dispensed simultaneously.

8. The method of claim 1 wherein the first and second powdered components are mounded up in the first and second recesses so as to extend above an upper edge of each recess.

9. The method of claim 1 wherein the substrate comprises a channel between the first and second recesses for receiving traces of the first and second components that may spill from the adjacent recesses.

10. A slip-resistant photo-luminescent device formed by the method of claim 1.

11. A slip-resistant photo-luminescent device comprising:

a substrate having at least one first recess and at least one second recess therein a strip of photo-luminescent material bonded to each first recess, a strip of friction-enhancing material bonded to each second recess, wherein both the strip of photo-luminescent material and strip of friction-enhancing material are formed from heat-curable powdered resins heated to fuse the resins and bond them to surfaces of the respective recesses.

12. The slip-resistant photo-luminescent device of claim 11 wherein the substrate includes a channel between the first and second recesses for receiving traces of the powdered resins that may spill from the adjacent recesses.

* * * * *